US005248053A

United States Patent [19]

Lundgren

[11] Patent Number: 5,248,053

[45] Date of Patent: Sep. 28, 1993

[54] OPERATING LEVER FOR BEVERAGE CONTAINER LEVER OPERATED OPENER

[76] Inventor: James F. Lundgren, 723 71st Ave. N., St. Petersburg, Fla. 33702

[21] Appl. No.: 726,123

[22] Filed: Jul. 1, 1991

Related U.S. Application Data

[63] Continuation of Ser. No. 474,522, Feb. 2, 1990, abandoned.

[51] Int. Cl.[5] ..... B65D 17/34

[52] U.S. Cl. ..... 220/269; 220/331

[58] Field of Search ..... 220/273, 270, 271, 272, 220/275, 269, 331

[56] References Cited

U.S. PATENT DOCUMENTS

| | | | |
|---|---|---|---|
| 3,250,425 | 5/1966 | Stec et al. | 220/273 |
| 3,341,055 | 9/1967 | Radford | 220/273 |
| 3,394,837 | 9/1966 | Hansen . | |
| 3,543,391 | 12/1970 | Henchert | 29/509 |
| 3,554,400 | 1/1971 | Bozek | 220/273 |
| 3,807,597 | 4/1974 | Wells . | |
| 3,860,143 | 1/1975 | Strobe . | |
| 3,977,561 | 8/1976 | Strobe . | |
| 4,024,981 | 5/1977 | Brown . | |
| 4,039,100 | 8/1977 | Wells . | |
| 4,148,409 | 4/1979 | Zundel . | |
| 4,211,335 | 7/1980 | Langseder . | |
| 4,247,014 | 1/1981 | Walz . | |
| 4,266,688 | 5/1981 | Reid . | |
| 4,276,993 | 7/1981 | Hasegawa | 220/269 |
| 4,367,996 | 1/1983 | Saunders | 413/14 |
| 4,480,763 | 11/1984 | Schneider | 220/269 |
| 4,524,879 | 6/1985 | Fundom et al. | 220/273 |
| 4,576,304 | 3/1986 | Henning . | |
| 4,690,297 | 9/1987 | Höft et al. | 220/273 |
| 4,951,835 | 8/1990 | DeMars et al. | 220/269 |

*Primary Examiner*—Allan N. Shoap
*Assistant Examiner*—Stephen Cronin
*Attorney, Agent, or Firm*—Frijouf, Rust & Pyle

[57] ABSTRACT

An improvement to an easy opening beverage container lever operated opener comprising a novel compound lever, utilizing an inclined plane and a pivoting operating lever, that easily raises primary positioned operating lever lift end to an attitude that allows operator to safely and efficiently engage a finger on operating lever lift end and proceed with opening process.

10 Claims, 2 Drawing Sheets

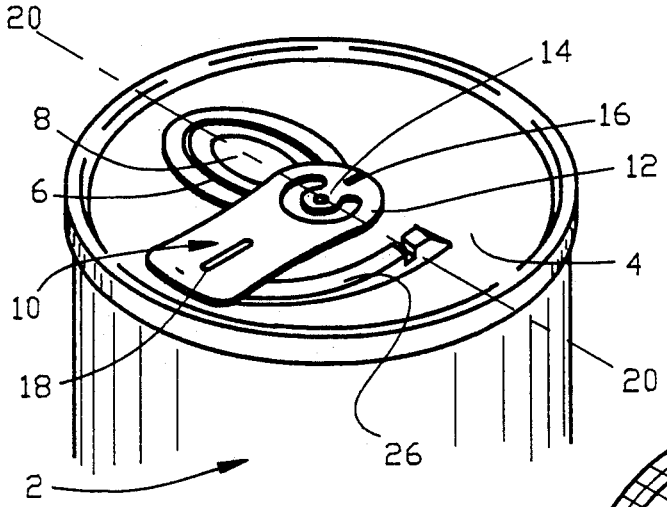
FIG. 1
FIG. 2
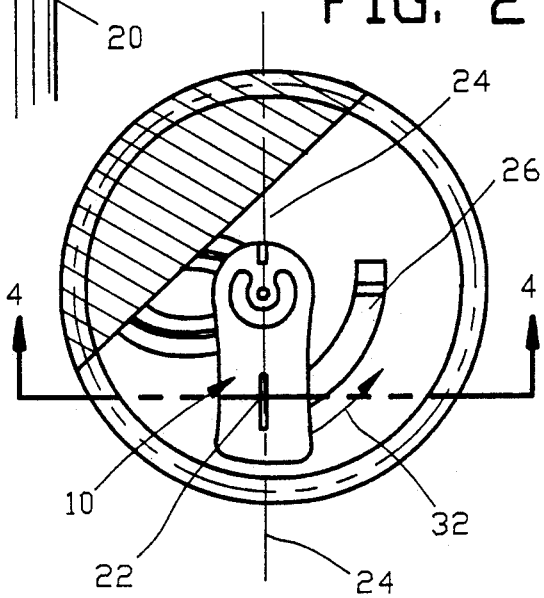
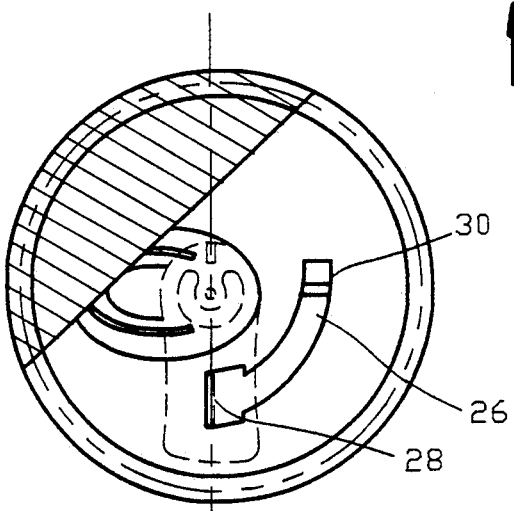
FIG. 3
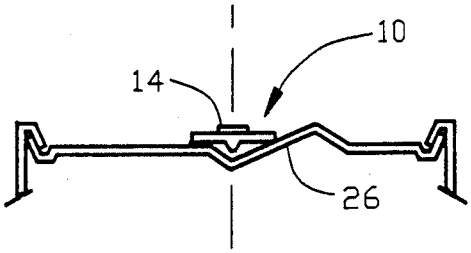
FIG. 4
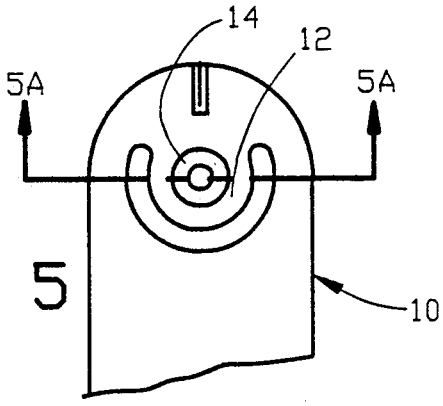
FIG. 5
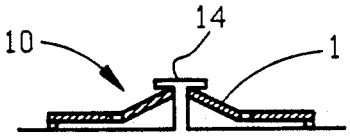
FIG. 5A

OPERATING LEVER FOR BEVERAGE CONTAINER LEVER OPERATED OPENER

This application is a continuation of application Ser. No. 474,522 filed Feb. 2, 1990 now abandoned.

BACKGROUND OF THE INVENTION

1. Field of the Invention

This invention relates to an easy opening container employing a lever operated opener and, more specifically, to a novel lever and container end structure resulting in improved lifting characteristics for a primary positioned operating lever.

2. Prior Art Statement

State of the art beverage container lever operated opening mechanism teaches that in order to effectively place one's finger on the operating lever of an opening mechanism, one must first engage in an unsafe and inconvenient act of inserting one's fingernail or some thin object between the operating lever lift end and beverage container top panel. This must be done in order to pry up the lever to a point where one can effectively engage one's finger on the contact surface of the operating lever.

Hasegawa in U.S. Pat. No. 4,276,993 discloses a typical representation of present state of the art beverage container lever operated opening mechanism. Hasegawa shows a phase of lifting an operating lever of beverage container lever opening mechanism. However, Hasegawa fails to show the unsafe and inconvenient act of initial lifting of operating lever.

Thus a need exists for a beverage container lever that overcomes problems associated with the aforementioned typical representation of the prior art devices. It is to the provision of such an opening mechanism that this invention is primarily directed.

SUMMARY OF THE INVENTION

The primary object of this invention is to provide for the safe and efficient lifting of an operating lever of a typical easy opening beverage container having a top panel with a scored area defining a closure disk adapted to be severed from the panel and pushed into container. An operating lever with an anchoring lug is riveted to the top panel. The operating lever has a nose portion at one end, generally overlying the disk and a lift portion at the opposite end. The improvement comprises a novel incline plane cooperating with the operating lever, that easily raises the operating lever lift end to an attitude that allows an operator to safely and efficiently engage a finger on the operating lever lift end and proceed with the opening process. The lever is initially positioned at a right angle to the longitudinal axis of container scored closure disk. The lever is fastened to the top panel by a rivet like device by an improved arched anchoring lug. The spring action of the arched anchoring lug allows the rivet to hold the lever firmly while still permitting free lateral movement. The incline plane at the top panel has a radius which is centered generally on the lever anchoring lug rivet. The incline plane originates with a minimum elevation at the lever location and terminates with maximum elevation at a point generally in line with the longitudinal axis of the scored closure disk. To operate the opener lever, the lever is laterally pivoted up the incline plane to a point where a lever body longitudinal axis is generally in line with a longitudinal axis of the container scored closure disk. At this point, because of the compound action of the lever and the incline plane, the nose of the lever is depressing and partially opening the openable segment. At the opposite end of the lever, the lift end of the lever is raised to a point where an operator can safely and efficiently engage a finger on lever contact surface and complete the opening process.

BRIEF DESCRIPTION OF THE DRAWINGS

FIG. 1 is a top perspective view of a container embodying the invention.

FIG. 2 is a plan view showing the improved lever and top panel structure.

FIG. 3 is a plan view showing the improved top panel structure with the lever in phantom.

FIG. 4 is a cross section of FIG. 2 taken at line 4—4.

FIG. 5 is a fragmentary top view of the operating lever showing a nose end and associated arched anchoring lug.

FIG. 5*a* is a cross section of FIG. 5 taken at line 5*a*—5*a* showing the arched anchoring lug.

DETAILED DISCUSSION

Figure 6:
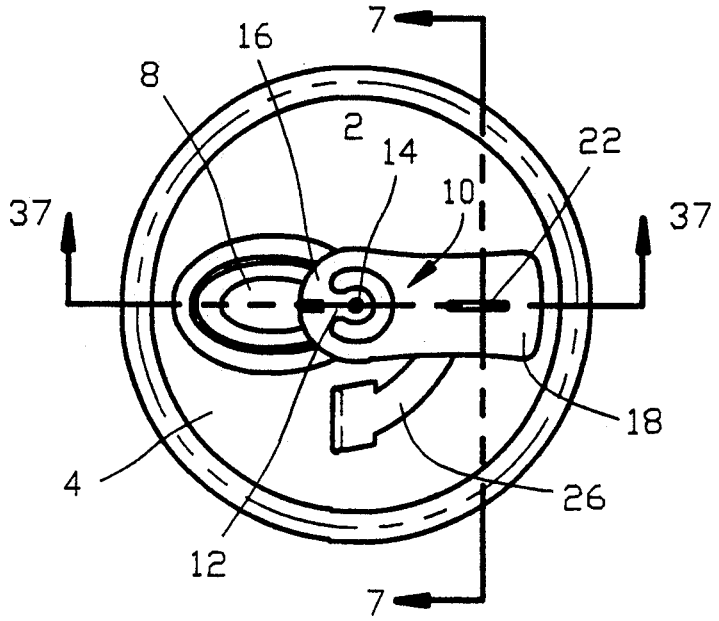
FIG. 6 is a plan view showing the improved lever and top panel structure with the lever in position to safely and easily complete the opening process.
Figure 6A:
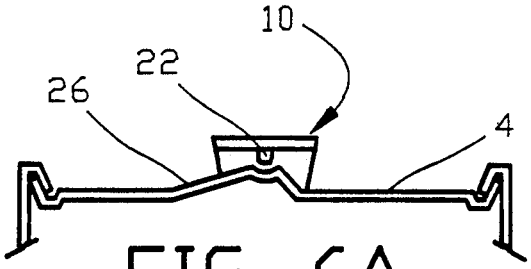
FIG. 6*a* is a cross section of FIG. 5 taken at line 6*a*—6*a*.
Figure 8:
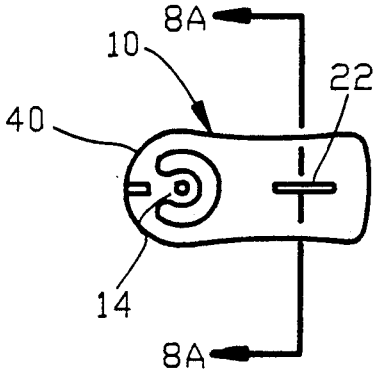
FIG. 8 is a top view of the operating lever body.
Figure 7:
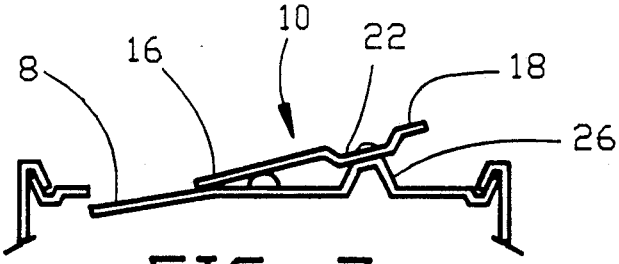
FIG. 7 is a cross section of FIG. 6 taken at line 7, 7 showing operating lever lift end at a maximum elevation and the operating lever nose end depressing the container openable segment.
Figure 8A:
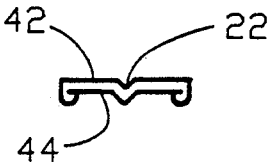
FIG. 8*a* is a cross section of the operating lever body of FIG. 8 taken at line 8*a*–8*a* showing a peripheral edge rolled over from a top surface to an underside of said lever body.
Figure 8B:
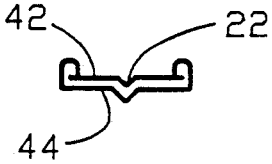
FIG. 8*b* is an alternative, a cross section of an operating body of FIG. 8 taken at line 8,8 showing the peripheral edge rolled over from the underside to the surface of the lever body.
Figure 8C:
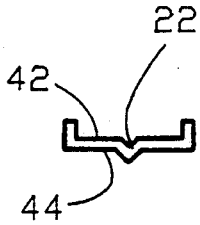
FIG. 8*c* is, alternatively, a cross section of operating lever body of FIG. 8 taken at line 8,8 showing turned up peripheral edge.

The invention is shown as it relates to a typical easy opening beverage container 2 having a top panel 4 with a scored area 6 defining a closure disk 8 adapted to be severed from the top panel 4 and pushed into the container 2. An operating lever 10 having an anchoring lug 12 is secured by a rivet 14 to the top panel 4. The operating lever 10 has a nose portion 16 at one end generally overlying the closure disk 8 and a lift portion 18 at an opposite end. The top panel 4 is shown in FIGS. 1–5*a* with the improved operating lever 10 in a primary position on the top panel 4 structure as it applies to a typical beverage container lever 10. The operating lever 10 is capable of pivoting around the anchoring rivet 14 and is generally positioned at a right angle to a longitudinal axis 20, 20 of the scored closure disk 8 when the operating lever is in the primary position. FIG. 5 and 5*a* show an embodiment of the operating lever 10 comprising an arched anchoring lug 12, the spring action of which allows the top panel 4 anchoring rivet 14 to hold lever 10 firmly while facilitating pivoting of the lever 10 about the rivet 14. FIG. 2 shows a lever 10 having an elongated indentation 22 placed generally along a longitudinal axis 24,24 of a lever body top surface and depressed below an underside of the lever, and spaced generally along the length of the lever body 10. The elongated lever body indentation 22 provides longitudinal rigidity to the lever body 10. The body indentation 22 projects below a bottom surface of the lever body to provide a bearing surface and effectively raises the vertical height of lever body, and, in conjunction with improved top panel construction, effectively limits the pivoting of the lever. As shown in FIG. 8*a*, the lever body peripheral edge 40 is rolled over from a top surface 42 to an underside 44 to provide safety and lever 10 body rigidity. Alternatively, as shown in FIG. 8*b*, the lever 10 body peripheral edge 40 is rolled up from the underside 44 to the top surface 42. FIG. 8*c* shows the peripheral edge is turned up to provide rigidity and a broader operator contact area. An inclined plane 26 at the top panel 4 surface has a radius generally centered on the lever lug rivet 14 The inclined plane originates with a minimum elevation at the primary position of lever 10 and terminates with a maximum elevation, at a point generally in line with the longitudinal axis 20, 20 of the scored closure disk 8. Alternatively, the incline plane 26 radius varies as the incline plane extends from the minimum to the maximum elevation. Lever lateral 32 movement limiting means 28 and 30 are provided at each end of incline plane 26 for limiting the movement of the lever 10.

To operate the lever operated beverage container opener the lever 10 is laterally moved pivoting lever 10 up the incline plane 26 to a point where the lever body longitudinal axis 24, 24 is generally in line with the container scored closure disk longitudinal axis 20 to lift lever end. Riding on projecting elongated lever body indentation 22, the lever end 18 is now at the highest incline plane 26 elevation. As a result of the raising of the lever lift end 18, the opposite end of the lever, the nose 16, is depressed downward and applies force to and partially sever closure disk 8. Operating lever 10 lift end 18 is now raised to a point where operator can safely and efficiently engage a finger on lever lift end 18 and complete the opening process.

What is claimed is:

1. An opener for a container, comprising:

a top panel for securing to the container;

said top panel having a scored area for defining a closure portion which is frangibly secured to said top panel for enabling said closure portion to be severed from said panel to open the container;

said top panel having an elevated portion defined in said top panel which is elevated relative to said top panel;

an operating lever having a nose portion and a lift portion;

means for rotatably securing said operating level to said top panel with said nose portion of said operating lever being disposed proximate said closure portion and with said lift portion disposed adjacent said elevated portion for enabling an operator to rotate said lift portion of said operating lever onto said elevated portion of said top panel to cause said nose portion of said operating lever to at least partially sever said closure portion from said top panel;

said elevated portion defined in said top panel including an inclined plane extending from a surface of said top panel;

said lift portion of said operating lever rides up said inclined plane upon rotation of said operating lever relative to said top panel; and means for limiting the rotation of said operating lever relative to said top panel exclusively to said inclined plane.

2. An opener for a container as set forth in claim 1, wherein said means for rotatably securing said operating lever to said top panel includes an anchoring rivet for rotatably securing said operating lever to said top panel.

3. An opener for a container as set forth in claim 1, wherein said means for rotatably securing said operating lever to said top panel includes an anchoring rivet interposed between said lift portion and said nose portion of said operating lever.

4. An opener for a container as set forth in claim 1, wherein said means for rotatably securing said operating lever to said top panel includes an anchoring rivet interposed between said lift portion and said nose portion of said operating lever; and said lift portion of said operating lever has a greater longitudinal length than a longitudinal length of said nose portion for providing a mechanical advantage for said operating lever.

5. An opener for a container as set forth in claim 1, wherein said means for rotatably securing said operating lever to said top panel includes an anchoring rivet interposed between said lift portion and said nose portion of said operating lever;

said lift portion of said operating lever having a greater longitudinal length than a longitudinal length of said nose portion for providing a mechanical advantage for said operating lever;

said elevated portion defined in said top panel including an inclined plane extending from a surface of said top panel; and said lift portion of said operating lever rides up said inclined plane upon rotation of said operating lever relative to said top panel to couple a mechanical advantage of said inclined plane to said mechanical advantage of said operating lever.

6. An opener for a container as set forth in claim 1, wherein said top panel is substantially circular;

said means for rotatably securing said operating lever to said top panel includes an anchoring rivet being located generally central of said substantially circular top panel; and said elevated portion being arcuately defined in said top panel about said anchoring rivet.

7. An opener for a container as set forth in claim 1, wherein said operating lever includes an elongated identation extending generally along a longitudinal length of said operating lever and protruding below an underside of said operating lever for strengthening said operating lever.

8. An opener for a container, comprising:

a top panel for securing to the container;

said top panel having a scored area for defining a closure portion which is frangibly secured to said top panel for enabling said closure portion to be severed from said panel to open the container;

said top panel having an elevated portion defined in said top panel which is elevated relative to said top panel;

an operating lever having a nose portion and a lift portion;

means for rotatably securing said operating lever to said top panel with said nose portion of said operating lever being disposed proximate said closure portion and with said lift portion disposed adjacent said elevated portion for enabling an operator to rotate said lift portion of said operating lever onto said elevated portion of said top panel to cause said nose portion of said operating lever to at least partially sever said closure portion from said top panel; and means for limiting the rotation of said operating lever relative to said top panel.

9. An opener for a generally cylindrical metallic beverage container, comprising:

a generally circular top panel for securing to the container;

said top panel having a scored area for defining a closure portion which is frangibly secured to said top panel for enabling said closure portion to be severed from said panel to open the container;

an operating lever having a nose portion and a lift portion;

an anchoring rivet interposed between said lift portion and said nose portion of said operating lever for rotatably mounting said operating lever to said top panel;

said anchoring rivet being located generally central of said substantially circular top panel;

said lift portion of said operating lever having a greater longitudinal length than a longitudinal length of said nose portion for providing a mechanical advantage for said operating lever;

said top panel having an inclined plane defined in said top panel and extending from a surface of said top panel to a position which is elevated relative to said top panel;

said inclined plane being arcuately defined in said top panel about said anchoring rivet;

said anchoring rivet rotatably secures said operating lever with said nose portion of said operating lever being disposed proximate said closure portion and with said lift portion being disposed adjacent said inclined plane; and said lift portion of said operating lever rides up said inclined plane upon rotation of said operating lever relative to said top panel by an operator to couple a mechanical advantage of said inclined plane to said mechanical advantage of said operating lever causing said nose portion of said operating lever to at least partially sever said closure portion from said top panel; and means for limiting the rotation of said operating lever relative to said top panel.

10. An opener for a container as set forth in claim 9, wherein said operating lever includes an elongated identation extending generally along a longitudinal length of said operating lever and protruding below an underside of said operating lever for strengthening said operating lever.

* * * * *